US008277678B2

(12) United States Patent
Cheng et al.

(10) Patent No.: US 8,277,678 B2
(45) Date of Patent: Oct. 2, 2012

(54) POLYMER-BONDED MAGNETIC MATERIALS

(75) Inventors: Ka Wai Eric Cheng, Hong Kong (HK); Yuen Wah Wong, Hong Kong (HK); Wei Tai Wu, Hong Kong (HK); Kai Ding, Hong Kong (HK); Yiu Lun Ho, Hong Kong (HK); Tsz Kong Cheung, Hong Kong (HK); Chi Keong Cheong, Hong Kong (HK)

(73) Assignee: The Hong Kong Polytechnic University, Hong Kong (CN)

( * ) Notice: Subject to any disclaimer, the term of this patent is extended or adjusted under 35 U.S.C. 154(b) by 799 days.

(21) Appl. No.: 12/039,592

(22) Filed: Feb. 28, 2008

(65) Prior Publication Data

US 2009/0218539 A1 Sep. 3, 2009

(51) Int. Cl.
*H01F 1/113* (2006.01)
*H01F 1/37* (2006.01)

(52) U.S. Cl. ..... 252/62.54; 252/62.62

(58) Field of Classification Search ..... 252/62.54
See application file for complete search history.

(56) References Cited

U.S. PATENT DOCUMENTS 4,200,547 A * 4/1980 Beck ..... 252/62.54
4,696,725 A * 9/1987 Ochiai et al. ..... 252/62.54
5,198,138 A * 3/1993 Yamamoto et al. ..... 252/62.54
5,958,283 A * 9/1999 Schmid et al. ..... 252/62.54
6,872,325 B2 * 3/2005 Bandyopadhyay et al. ..... 252/62.54
7,014,969 B2 * 3/2006 Yachi et al. ..... 430/108.7
7,311,854 B2 * 12/2007 Takenoshita ..... 252/62.62

OTHER PUBLICATIONS

Ding et al., "Research on Polymer-Bonded Magnetic Materials for a Buck Converter", 2006 2nd International Conference on Power Electronics Systems and Applications, pp. 87-90, (2006).
Park et al., "Hybrid Double Wall Nanotube of Conducting Polymer and Magnetic Nickel", Mol. Cryst. Liq. Cryst. vol. 445, pp. 101-106, (2006).
Jiles, "Recent Advances and Future Directions in Magnetic Materials", Acta Mater., vol. 51, pp. 5907-5939, (2003).
Wu et al., "Temperature Dependence of Magnetic Properties of a Polymer Bonded Magnetic Material", 2006 2nd International Conference on Power Electronics Systems and Applications, pp. 73-76, (2006).
Cheng, "Computation of the AC Resistance of Multistranded Conductor Inductors with Multilayers for High Frequency Switching Converters", IEEE Transactions on Magnetics, vol. 36, No. 4, pp. 831-834, (2000).
Cao et al., "Synthesis and Properties of Magnets/Polyethylene Composites", Journal of Applied Polymer Science, vol. 74, pp. 3412-3416, (1999).
Wang et al., "A New Route for Preparing Magnetic Polyolefins with Well Dispersed Nanometer Magnetic Particles in Polymer Matrix Using Supported $Fe_3O_4/AIR_3/TiCl_4$ Nanometer Magnetic Ziegler-Natta Catalyst", Journal of Materials Science Letters, vol. 18, pp. 1489-1491, (1999).
Cheng et al., "Parallel-Mode Extended-Period Quasiresonant Convertor", IEE Proceedings-B, vol. 138, No. 5, pp. 243-251, (1991).

* cited by examiner

*Primary Examiner* — Carol M Koslow
(74) *Attorney, Agent, or Firm* — Wilkinson & Grist; George G. Wang

(57) ABSTRACT

A magnetic composition for power conversion includes a thermoplastic polymer and magnetic powders. The composition has a tensile strength of greater than 20 N/mm$^2$.

10 Claims, 5 Drawing Sheets

MAX LOAD EXT.

| (N) | (mm) |
|---|---|
| 5212.0 | 2.046 |

MAX LOAD EXT

| (N) | (mm) |
|---|---|
| 1049.0 | 0.0000 |

POLYMER-BONDED MAGNETIC MATERIALS

BACKGROUND

The design of magnetic power converters depends on factors including the permeability, loss factor, and size and shape of the magnetic material in the converter. Specifically, the loss for magnetic material usually accounts for 30-40% of the total loss of the converter. Conventional magnetic materials, such as Ferrites and Molydbenum Permalloy Powder (MPP), are known for their low loss characteristics and high frequency operation. Therefore, these magnetic materials may be used in power converters, such as inductors and transformers. However, these magnetic materials suffer from a number of disadvantages, including limited size, brittleness, high loss and high cost.

For example, it is difficult to provide a transformer or inductor useful in high power conversion, such as a system of more than 20 kW, because of the complexity and expense in the formation of Ferrites or powder iron. In addition, conventional materials must be screened in this application. A metal and plastic material chassis is often used to screen electromagnetic emissions, which increases the cost and the weight of the electronic product.

The loss in power conversion can be divided into conductor loss and core loss. The conductor loss, or winding loss, is the resistive loss due to the current passed through the winding around the magnetic material. Because of the current distribution in the conductor at high frequency, this loss can increase dramatically as the frequency increases. The core loss is usually caused by the hysteresis, eddy loss and/or residue loss of the magnetic materials. The hysteresis loss and eddy loss can be decreased by using power iron core for high frequency application. The introduction of polymer into the conventional core could also lower the eddy loss to some extent, which could extend their applications to a broader range at high frequency area.

The technology and engineering domains constantly set demanding requirements of magnetic materials. Recently, polymer bonded magnetic materials have attracted a great deal of attention in the fields of magneto-electrics and magneto-optics. These materials are composed of polymer matrices and magnetic powders, which may be produced using traditional polymer processing methods. Polymer bonded magnetic materials offer significant advantages over conventional materials. For example, polymer bonded magnetic materials can be molded more easily, lowering the cost of manufacturing and of quality control. Nonetheless, the polymer-bonded magnetic materials have not typically been applicable in power conversion or electromagnetic interference. The outstanding work needed in the optimization and the permeability study has prevented developing the materials into a product.

It is desirable to produce a magnetic material that could be easier to form into device cores for application in high power conversion (over 20 kW). Ideally, these magnetic materials would have sufficient flexibility. It is also desirable to manufacture the magnetic material at a low cost. It is further desirable to produce a magnetic material that is light weight. It is also desirable to produce a magnetic material useful for high frequency power conversion, such as over 100 s kHz operation. It is further desirable to that the magnetic material is applicable in power transformers and inductors.

BRIEF SUMMARY

According to one aspect, a magnetic composition for power conversion includes a thermoplastic polymer and magnetic powders. The composition has a tensile strength of greater than 20 N/mm$^2$.

According to another aspect, a method of making a magnetic composition for power conversion includes mixing $Fe_2O_3$, NiO and ZnO into a mixture in a high-speed blender, crushing the mixture in a high-speed blender into magnetic powders, mixing dried PMMA pellets with Stearic acid ($C_{18}H_{36}O_2$) in a high-speed blender to form polymer powders with appropriate size, and mixing the magnetic powders and the polymer powders in a high-speed blender.

DETAILED DESCRIPTION

Figure 1A:
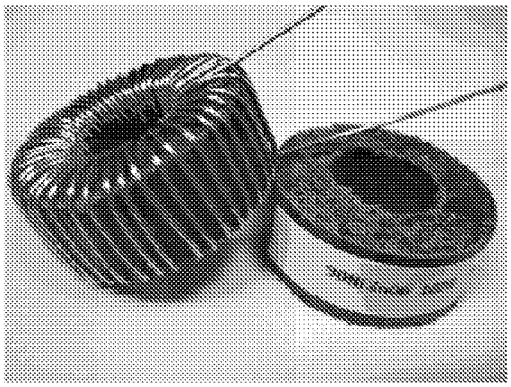
FIG. 1A depicts the ring cores based on 10 wt % PE-90 wt % FeNiZn(50:20:30 mol) (1300° C., 950 minutes).
Figure 1B:
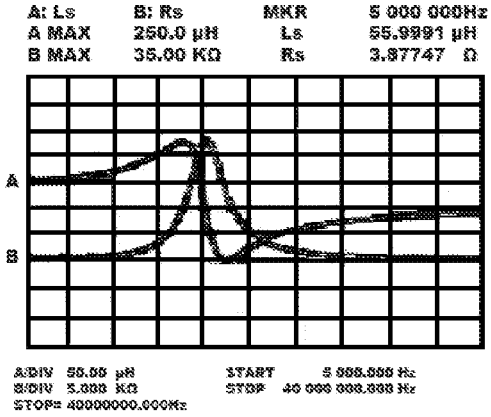
FIG. 1B depicts the measurement results of FIG. 1A, with initial values: f=5 KHz, L=56.00 μH, $\mu_r$=42.17 and peak values: f=14.30 MHz, L=125.89 μH, $\mu_r$=94.80.
Figure 2A:
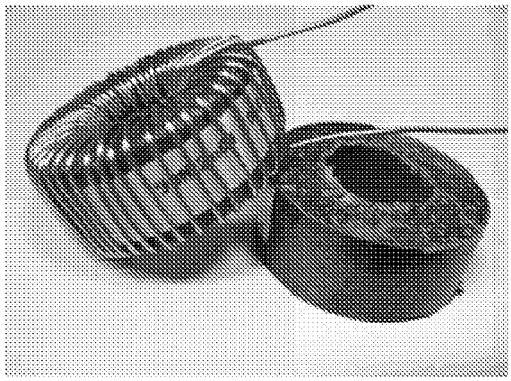
FIG. 2A depicts the ring cores based on 10 wt % PE-90 wt % FeNiZn(50:30:20 mol) (1300° C., 950 minutes).
Figure 2B:
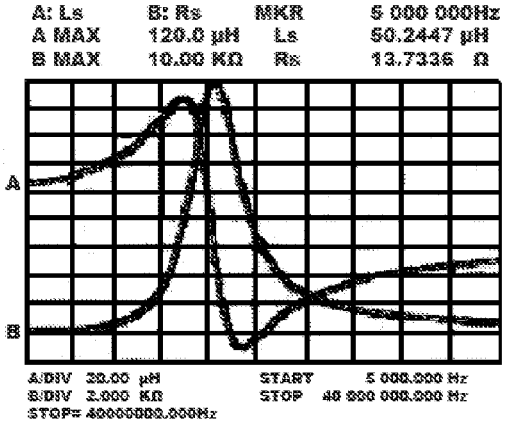
FIG. 2B depicts the measurement results of FIG. 2A, with initial values: f=5 KHz, L=50.49 μH, $\mu_r$=38.02 and peak values: f=13.70 MHz, L=108.62 μH, $\mu_r$=81.79.
Figure 3A:
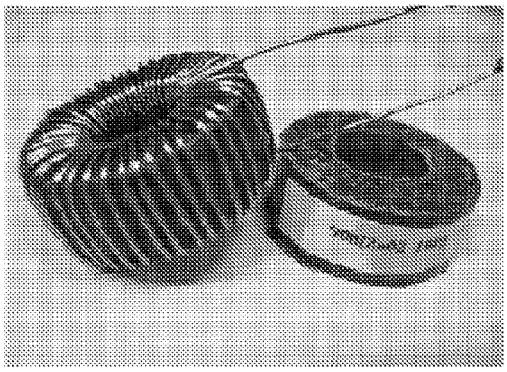
FIG. 3A depicts the ring cores based on 10 wt % PE-90 wt % FeNiZn(50:40:10 mol) (1300° C., 950 minutes).
Figure 3B:
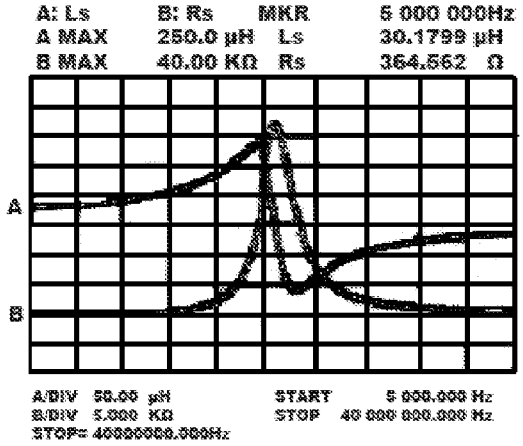
FIG. 3B depicts the measurement results of FIG. 3A, with initial values: f=5 KHz, L=38.30 μH, $\mu_r$=28.94 and peak values: f=19.30 MHz, L=135.91 μH, $\mu_r$=102.34.
Figure 4A:
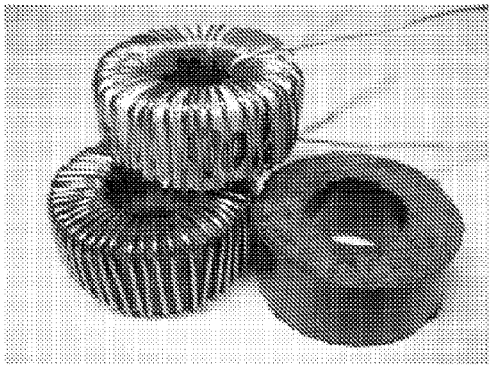
FIG. 4A depicts the ring cores based on 10 wt % PE-90 wt % FeNiZn(50:20:30 mol) (1100° C., 20 hours).
Figure 4B:
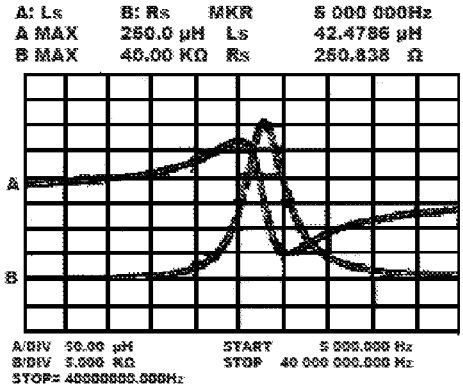
FIG. 4B depicts the measurement results of FIG. 4A, with initial values: f=5 KHz, L=43.98 μH, $\mu_r$=33.12 and peak values: f=20.2 MHz, L=120.15 μH, $\mu_r$=90.47.

Reference will now be made in detail to a particular embodiment of the invention, examples of which are also provided in the following description. Exemplary embodiments of the invention are described in detail, although it will be apparent to those skilled in the relevant art that some features that are not particularly important to an understanding of the invention may not be shown for the sake of clarity.

Furthermore, it should be understood that the invention is not limited to the precise embodiments described below, and that various changes and modifications thereof may be effected by one skilled in the art without departing from the spirit or scope of the invention. For example, elements and/or features of different illustrative embodiments may be combined with each other and/or substituted for each other within the scope of this disclosure and appended claims. In addition, improvements and modifications which may become apparent to persons of ordinary skill in the art after reading this disclosure, the drawings, and the appended claims are deemed within the spirit and scope of the present invention.

A magnetic composition may include a thermoplastic polymer and magnetic powers. The composition has a tensile strength of greater than 20 $N/nm^2$. Formed magnetic cores including the magnetic composition may have better mechanical properties than conventional cores. For example, magnetic cores including the magnetic composition may have a tensile strength of greater than 20 $N/mm^2$, and may have a resistance to compression of greater than 40 $N/mm^2$. Magnetic cores including the magnetic composition may be used for power conversion applications, such as power transformers, power inductors, and ferrites screens.

Composition

A magnetic composition for power conversion may include a thermoplastic polymer and a magnetic powder. The thermoplastic polymer may be taken from the group consisting of poly(methyl methacrylate) (PMMA) and polyethylene (PE). Other polymers, such as Nylon 6, may also be used, which may vary the operational temperature of the products. The magnetic powder may be taken from the group consisting of Nickel, Cobalt, NiZn Ferrite, and MnZn Ferrite. Optionally, a coupling agent of Titanium (IV) Isopropoxide ($C_{12}H_{28}O_4Ti$) may be included in the composition. For example, the composition may contain from about 10 to 40 weight percent of the thermoplastic polymer, from about 60 to 90 weight percent of the magnetic powder, and the magnetic powder may contain about 15 weight percent of the coupling agent.

Methods

To produce the polymer-bonded magnetic material, appropriate amounts of $Fe_2O_3$, NiO and ZnO in different mole ratios (50:20:30, 50:30:20, or 50:40:10) may be vigorously mixed in a high-speed blender for about 2 minutes. The mixture may then be sintered in a high-temperature calcination furnace. The furnace may be heated at a rate of 8° C./min to 1300° C. and maintained at this temperature for 950 minutes. The melted mixture may be taken out immediately, which may then be placed at about 20° C., and allowed to cool down to room temperature rapidly. The cooled mixture may then be crushed in a high-speed blender to provide magnetic powders.

To remove most of the moisture in the mixture, PMMA pellets may be dried in an oven at about 60° C. for about 6 hours, and the magnetic powders may be also dried in an oven at about 60° C. for about 4 hours. To modify the surface properties of the magnetic powders, the dried magnetic powders may be vigorously mixed with Titanium (IV) Isopropoxide ($C_{12}H_{28}O_4Ti$) in a high-speed blender. The dried magnetic powders may contain about 15 weight percent of $C_{12}H_{28}O_4Ti$. Then, the mixture may be dried in an oven at about 60° C. for about 3 hours. Such a modification may improve the compatibility between the magnetic powders and the polymer, which in turn may improve the properties of the composite.

The dried PMMA pellets may be mixed with Stearic acid ($C_{18}H_{36}O_2$) in a high-speed blender to form polymer powders with appropriate size. The dried PMMA may contain about 2 weight percent of $C_{18}H_{36}O_2$. The modified magnetic powders and polymers may then be vigorously premixed in a high-speed blender. This mixture may be blended further using a single-screw extruder operating at an appropriate rotation speed. The temperature setting may be selected as: Zone 1 at 210° C., Zone 2 at 230° C., Zone 3 at 265° C., and Zone 4 at 260° C. The extrusion may become difficult at lower temperatures, while higher temperatures may cause inconsistency in properties. The mixture may then be placed in a predefined mould and made into a magnetic core in a hot press machine operated at above 150° C. at 6 to 10 ton press, which is above the melting point of the polymer to be used in the magnetic core.

Figure 8:
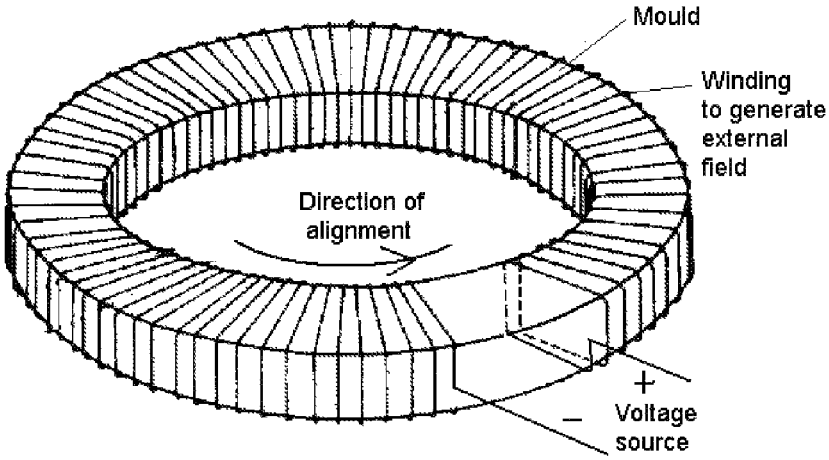
FIG. 8 depicts how external field may be applied to aid the alignment of a magnetic dipole by using a hot-press machine.

To increase the permeability of the magnetic cores, an external magnetic field may be applied to aid the alignment of the magnetic dipole inside the magnetic materials. The external magnetic field may be supplied from a permanent magnetic or an electric-winding. The magnetic filed applied may be in the same direction as the main field direction of the core under construction as depicted in FIG. 8.

While not being bound by theory, it is believed that an evenly distributed air-gap in the magnetic composition may reduce the fringe field and/or reduce the eddy current loss, which is desirable for high frequency power electronics.

Products

Figure 9:
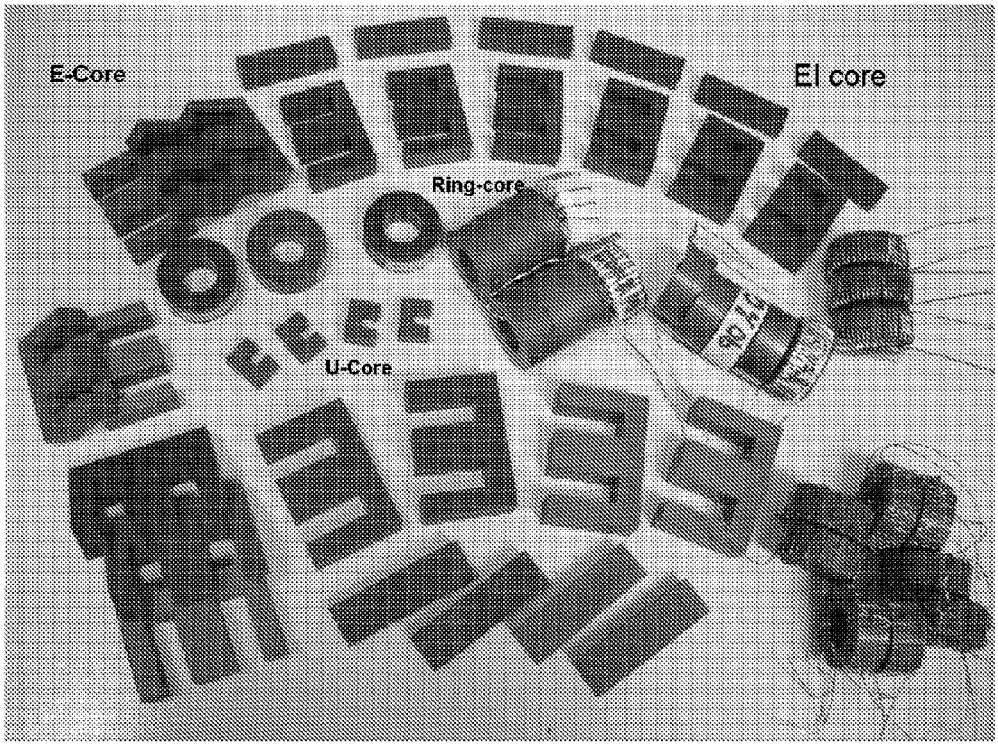
FIG. 9 depicts constructed embodiments of the polymer-bonded magnetic core.

Magnetic cores based on the polymer-bonded magnetic materials may be fabricated on a hot-press machine operated at 180° C. and at about 6 to 10 tons, with a mould of desired shape. Magnetic cores fabricated using the magnetic composition may have various shapes, such as a ring, an EE, an EI, and a U shape, as depicted in FIG. 9. An EE-shape refers to when the shape of the magnetic core is in the geometry of two letter Es. An EI-shape refers to when the shape of the magnetic core is in the geometry of a letter E and a letter I. A U-shape refers to when the shape of the magnetic core is in the geometry of a letter U. A ring-shape refers to the shape of the magnetic core is similar to a circular ring. Other shapes, such as irregular geometry, may also be used.

A formed magnetic core includes the magnetic composition may have better mechanical properties than the conventional magnetic cores. For example, the magnetic cores may have a tensile strength of greater than 20 $N/mm^2$ and a resistance to compression of greater than 40 $N/mm^2$.

Magnetic cores including the magnetic composition may be used, for example, as power transformers, power inductors, and ferrites screens.

EXAMPLES

Example 1

The Magnetic Properties of the Composition

The magnetic properties measurements were carried out on a ring core (Ø30×Ø15×H12 mm). Inductance (L) was measured on a HIOKI 3530 LCR Hi Tester, and then the relative permeability $\mu_r$ was calculated. From the equivalent circuit of the ring core shown above, the impedance Z should be $Z=R_s+j\omega L_s$.

And $Z=j\omega L_0(\mu'-j\mu'')$. Herein, $\mu'$ and $\mu''$ is the real part and the imaginary part of the magnetic permeability, respectively. $\omega$ is the rotational frequency. Then, $$R_s + j\omega L_s = j\omega L_0(\mu' - j\mu'')$$

$$\text{Quality factor}: Q = \frac{\omega L}{R},$$

$$\text{thus } \mu' = \frac{L_s}{L_0}, \mu'' = \frac{\mu'}{Q}$$

Also, the inductance value $L_o$ of the air $$L_0 = \frac{4\pi N^2 A_e}{l_e} \times 10^{-9},\ \frac{A_e}{l_e} = 2\pi h \ln\left(\frac{r_2}{r_1}\right)$$

Herein, N is the loop number. Ae is the effective area of the flux. le is the effective length of the magnetic circuit. $r_1$ is the inside diameter, $r_2$ is the inside diameter, and h is the highness of the ring core.

Finally, $$\mu' = \frac{L_s \times 10^9}{8\pi^2 N^2 h \ln\left(\frac{r_2}{r_1}\right)}$$

$$\mu = \frac{L_s \times 10^9}{8\pi^2 N^2 h \ln\left(\frac{r_2}{r_1}\right)} \cdot \sqrt{1 + 1/Q^2}$$

Typical images are shown in FIGS. 1 to 4, wherein Loop Number N=45, $\mu_r \approx 0.753 \times L_s(\mu H)$. The results for the above results and those for other objects are concluded in Table 1 and Table 2.

TABLE 1

The inductance and relative permeability of the composition

| Samples' Composition | | 5 KHz | 50 KHz | 100 KHz | 500 KHz | 1 MHz | 2 MHz | 10 MHz |
|---|---|---|---|---|---|---|---|---|
| 10 wt % PE 90 wt % FeNiZn(50:20:30 mol) (1100° C., 950 minutes) | L (μH) | 43.98 | 42.55 | 42.40 | 42.03 | 41.98 | 42.29 | 55.54 |
| | $\mu_r$ | 33.12 | 32.04 | 31.93 | 31.65 | 31.61 | 31.84 | 41.82 |
| 10 wt % PE, 10% PMMA 80 wt % FeNiZn(50:20:30 mol) (1100° C., 950 minutes) | L (μH) | 42.40 | 41.45 | 41.29 | 40.91 | 40.86 | 41.03 | 50.91 |
| | $\mu_r$ | 31.93 | 31.21 | 31.09 | 30.80 | 30.77 | 30.90 | 38.34 |
| 30 wt % PE 70 wt % FeNiZn(50:20:30 mol) (1100° C., 950 minutes) | L (μH) | 16.40 | 16.00 | 15.91 | 15.73 | 15.70 | 15.70 | 16.84 |
| | $\mu_r$ | 12.35 | 12.05 | 11.98 | 11.84 | 11.82 | 11.82 | 12.68 |
| 40 wt % PMMA 60 wt % FeNiZn(50:20:30 mol) (1100° C., 950 minutes) | L (μH) | 13.65 | 9.95 | 9.84 | 9.69 | 9.65 | 9.64 | 10.03 |
| | $\mu_r$ | 10.28 | 7.49 | 7.41 | 7.30 | 7.27 | 7.26 | 7.55 |
| 10 wt % PE 90 wt % FeNiZn(50:20:30 mol) (1300° C., 950 minutes) | L (μH) | 56.00 | 55.45 | 55.26 | 54.86 | 55.01 | 55.59 | 80.58 |
| | $\mu_r$ | 42.17 | 41.75 | 41.61 | 41.31 | 41.42 | 41.86 | 60.68 |
| 10 wt % PE 90 wt % FeNiZn(50:30:20 mol) (1300° C., 950 minutes) | L (μH) | 50.49 | 49.38 | 49.27 | 48.98 | 49.06 | 49.77 | 77.51 |
| | $\mu_r$ | 38.02 | 37.18 | 37.10 | 36.88 | 31.19 | 37.48 | 58.37 |
| 10 wt % PE 90 wt % FeNiZn(50:40:10 mol) (1300° C., 950 minutes) | L (μH) | 38.30 | 37.94 | 37.84 | 37.53 | 37.47 | 37.61 | 48.86 |
| | $\mu_r$ | 28.94 | 28.57 | 28.49 | 28.26 | 28.21 | 28.32 | 36.79 |
| 80 wt % Co 20 wt % PMMA | L (μH) | 13.50 | 12.47 | 12.30 | 11.17 | 9.36 | 7.10 | — |
| | $\mu_r$ | 10.17 | 9.39 | 9.26 | 8.41 | 7.05 | 5.35 | — |
| 90 wt % Co 10 wt % PMMA | L (μH) | 14.00 | 12.39 | 12.28 | 11.88 | 11.12 | 9.41 | — |
| | $\mu_r$ | 10.54 | 9.33 | 9.25 | 8.95 | 8.37 | 7.09 | — |

TABLE 2

The inductance and relative permeability of the composition

| Samples' Composition | | 5 KHz | 10 KHz | 25 KHz | 50 KHz | 75 KHz | 100 KHz |
|---|---|---|---|---|---|---|---|
| 60 wt % Co-40 wt % PMMA | L (μH) | — | — | 1.34 | 1.32 | 1.32 | 1.32 |
| | $\mu_r$ | — | — | 16.89 | 16.63 | 16.63 | 16.63 |
| 70 wt % Co-30 wt % PMMA | L (μH) | 1.26 | 1.23 | 1.20 | 1.20 | 1.20 | 1.19 |
| | $\mu_r$ | 15.88 | 15.50 | 15.12 | 15.12 | 15.12 | 14.99 |
| 60 wt % Ni-40 wt % PMMA | L (μH) | — | — | 1.34 | 1.32 | 1.32 | 1.32 |
| | $\mu_r$ | — | — | 16.88 | 16.63 | 16.63 | 16.63 |
| 70 wt % Ni-30 wt % PMMA | L (μH) | 1.12 | 1.07 | 1.03 | 1.02 | 1.01 | 1.01 |
| | $\mu_r$ | 14.11 | 13.48 | 12.98 | 12.85 | 12.73 | 12.73 |

Example 2

The Tensile Strength of the Composition

Figure 5:
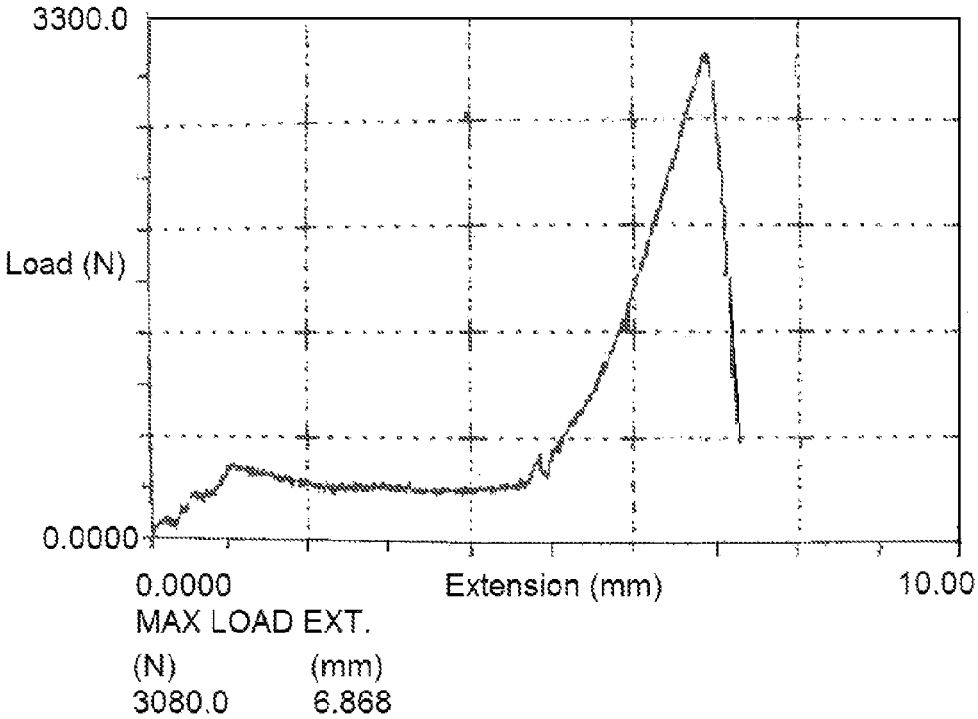
FIG. 5 depicts the typical curves of load (N) vs. extension (mm) in tensile strength measurements.

The tensile strength measurement was carried out on a Lloyd Instruments LR30KPLUS Series Universal Material Tester. FIG. 5 shows the typical curves of load (N) vs. extension (mm). The measurement results are listed in Table 3.

TABLE 3

The tensile strength of the composition

| Sample's Composition | Tensile Strength ($N/mm^2$) | Sample's Composition | Tensile Strength ($N/mm^2$) |
|---|---|---|---|
| 60 wt % FeNiZn(50:20:30 mol) - 40 wt % PMMA | 20.15 | 60 wt % FeNiZn(50:20:30 mol) - 40 wt % PE | 29.56 |
| 70 wt % FeNiZn(50:20:30 mol) - 30 wt % PMMA | 22.35 | 70 wt % FeNiZn(50:20:30 mol) - 30 wt % PE | 45.21 |
| | | 80 wt % FeNiZn(50:20:30 mol) - 20 wt % PE | 60.17 |
| | | 90 wt % FeNiZn(50:20:30 mol) - 10 wt % PE | 89.28 |

Example 3

The Resistance to Compression of the Composition

Figure 6:
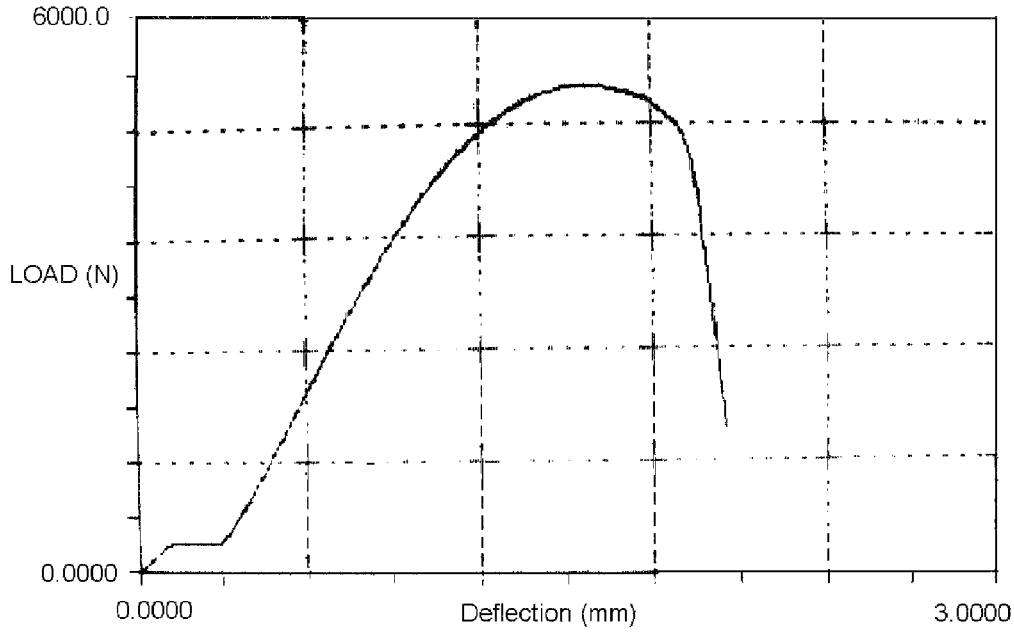
FIG. 6 depicts the typical curves of load (N) vs. deflection (mm) in resistance to compression measurements.
Figure 7:
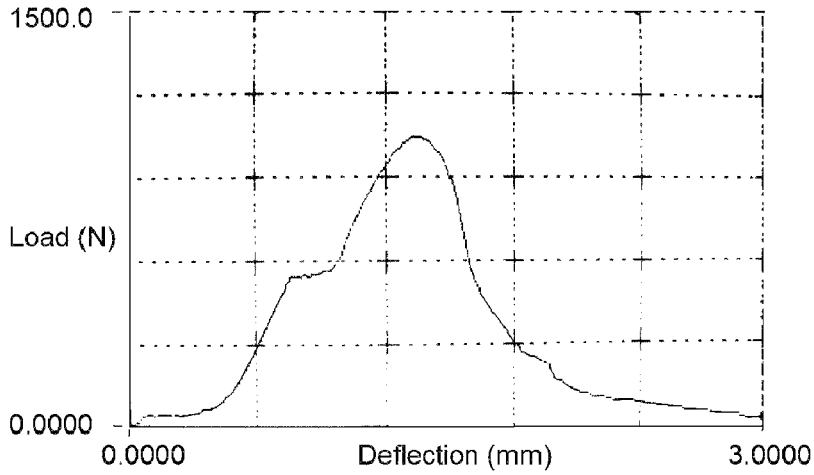
FIG. 7 depicts the typical curves of load (N) vs. deflection (mm) in radial crushing strength measurements.

The resistance to compression measurement was carried out on the rectangular samples on a Lloyd Instruments LR30 KPLUS Series Universal Material Tester. FIG. 6 shows the typical curves of load (N) vs. deflection (mm). The measurement results are concluded in Table 4.

TABLE 4

The resistance to compression of the composition

| Sample's Composition | Resistance to Compression ($N/mm^2$) | Sample's Composition | Resistance to Compression ($N/mm^2$) |
|---|---|---|---|
| 60 wt % FeNiZn(50:20:30 mol) - 40 wt % PMMA | 57.91 | 60 wt % FeNiZn(50:20:30 mol) - 40 wt % PE | 39.82 |
| 70 wt % FeNiZn(50:20:30 mol) - 30 wt % PMMA | 58.24 | 70 wt % FeNiZn(50:20:30 mol) - 30 wt % PE | 42.66 |
| | | 80 wt % FeNiZn(50:20:30 mol) - 20 wt % PE | 45.20 |
| | | 90 wt % FeNiZn(50:20:30 mol) - 10 wt % PE | 44.01 |

Example 4

The Radial Crushing Strength of the Composition

The radial crushing strength measurement was carried out on the ring core, and was calculated based on the following formula:

$$\sigma_r = \frac{1.908\, P_r(D-t)}{2Lt^2}$$

Herein, $P_r$ is the maximal load (N), D is the outer diameter, t is the thickness, and L is the width of the sample. The measurement results are concluded in Table 5.

TABLE 5

The radial crushing strength of the composition

| Sample's Composition | Radial Crushing Strength ($N/mm^2$) | Sample's Composition | Radial Crushing Strength ($N/mm^2$) |
|---|---|---|---|
| 60 wt % FeNiZn(50:20:30 mol) 40 wt % PMMA | 207.57 | 60% NiZn - 40% PE | 51.11 |
| 70 wt % FeNiZn(50:20:30 mol) 30 wt % PMMA | 342.36 | 70% NiZn - 30% PE | 75.02 |
| | | 80% NiZn - 20% PE | 72.56 |
| | | 90% NiZn - 10% PE | 29.29 |
| | | 90% NiZn - 10% UHMWPE 300 (UHMW = Ultra-High Molecular Weight) | 83.40 |
| | | 90% NiZn - 10% UHMWPE 500 | 102.13 |

Example 5

The Impact Resistance of the Composition

Impact resistance of the sample was measured on a ZWICK MS25B&C D-7900 Impact Resistance Tester. The measurements were carried out on cuboid samples (50×14×9 mm) with an incision of "V" shape. The impact resistance $A_{KV}$ equals to the impact value $A_K$ obtained. The measurement results are concluded in Table 6.

TABLE 6

The impact resistance of the composition

| Samples' Composition | Impact Resistance, $A_{KV}$ (J) |
|---|---|
| 60 wt % FeNiZn(50:20:30 mol) - 40 wt % PMMA | 0.25 J |
| 70 wt % FeNiZn(50:20:30 mol) - 30 wt % PE | 0.94 J |
| 90 wt % FeNiZn(50:20:30 mol) - 10 wt % PE | 0.43 J |

Example 6

The Rockwell Hardness of the Composition

Rockwell hardness was measured on an ESE WAY RB Hardness Tester. The measurements were carried out on cuboid samples (50×14×9 mm). The measurement results are concluded in Table 7.

TABLE 7

The Rockwell hardness of the composition

| Samples' Composition | Rockwell Hardness Number, HR | | | | | |
|---|---|---|---|---|---|---|
| | Rockwell Superficial 30-T 30 kg, 1/16 In ball | | Rockwell Standard F 60 kg, 1/16 In ball | | Rockwell Standard B 100 kg, 1/16 In ball | |
| 60 wt % FeNiZn(50:20:30 mol) 40 wt % PMMA | 94 | 94 | 119 | 121 | — | — |
| 70 wt % FeNiZn(50:20:30 mol) 30 wt % PE | 66 | 62 | — | — | — | — |
| 90 wt % FeNiZn(50:20:30 mol) 10 wt % PE | — | — | 94 | 94 | 78 | 79 |

While the examples of the magnetic composition have been described, it should be understood that the composition not so limited and modifications may be made. The scope of the composition is defined by the appended claims, and all devices that come within the meaning of the claims, either literally or by equivalence, are intended to be embraced therein.

REFERENCES

K. W. E. Cheng and P. D. Evans, 'Parallel-mode extended-period quasi-resonant convertor', IEE Proceedings-B, Vol. 138, No. 5, September 1991, pp. 243-251.

D. H. Park, J. H. Shim, B. H. Kim, K. Y. Bae, K. Kim, and J. Joo, "Hybrid double wall nanotube of conducting polymer and magnetic nickel", Mol. Cryst. Liq. Cryst. Vol. 445, pp. 101-106, 2006.

D. C. Jiles, "Recent advances and future directions in magnetic materials", Acta Mater., Vol. 51, pp. 5907-5939, 2003.

H. W. Ott, "Noise reduction techniques in electronic systems", New York: Wiley, 1987. X. Cao, Y. Luo and L. Feng, "Synthesis and properties of magnets/polyethylene composities", Journal of Applied Polmer Science, Vol. 74(14), December 1999, pp. 3412-3416.

L. Wang, L. X. Feng, T. Xie, X. F. Qing, "New route for preparing magnetic polyolefins with well dispersed nanometer magnetic particles in polymer matrix using supported Fe3O4/AlR3/TiCl4 nanometer magnetic Ziegler-Natta catalyst", Journal of Materials Science Letters, Vol. 18(18), September 1999, pp. 1489-1491.

K. W. E. Cheng, "Computation of the AC resistance of multistranded conductor inductors with multilayers for high frequency switching converters", IEEE Transactions on Magnetics, Vol. 36, No. 4, July 2000, pp. 831-834.

W.-T. Wu, Y. W. Wong, and K. W. Eric Cheng, "Temperature dependence of magnetic properties of a polymer bonded magnetic material", 2006 2nd International Conference on Power Electronics Systems and Applications, November 2006, pp. 73-76.

K. Ding, K. W. Eric Cheng, W.-T. Wu, and D. H. Wang, "Research on polymer-bonded magnetic materials for a buck converter", 2006 2nd International Conference on Power Electronics Systems and Applications, November 2006, pp. 87-90.

What is claimed is:

1. A method of making a magnetic composition for power conversion, comprising:

a step of preparing magnetic powders from $Fe_2O_3$, NiO and ZnO;

a step of mixing dried PMMA pellets with Stearic acid ($C_{18}H_{36}O_2$) in a high-speed blender to form polymer powders with appropriate size; and a step of mixing said magnetic powders and said polymer powders in a high-speed blender to afford a magnetic composition for power conversion.

2. The method of claim 1, wherein said step of preparing magnetic powders comprises mixing $Fe_2O_3$, NiO and ZnO into a mixture in a high-speed blender;

sintering said mixture in a high-temperature calcination furnace;

cooling said mixture to room temperature prior to crushing said mixture; and crushing said mixture in a high-speed blender into magnetic powders.

3. The method of claim 2, wherein said furnace is heated at a rate of 8° C./min to 1300° C. and maintained at this temperature for 950 minutes.

4. The method of claim 1, further comprising drying said PMMA pellets in an oven at about 60° C. for about 6 hours prior to mixing with said magnetic powders.

5. The method of claim 1, further comprising drying said magnetic powders in an oven at about 60° C. for about 4 hours after crushing said mixture.

6. The method of claim 5, further comprising mixing said dried magnetic powders with Titanium (IV) Isopropoxide ($C_{12}H_{28}O_4Ti$) in a high-speed blender.

7. The method of claim 6, wherein the mass ratio of C12H28O4Ti to said dried magnetic powders is about 15 weight percent.

8. The method of claim 6, wherein the mass ratio of $C_{18}H_{36}O_2$ to said dried PMMA is about 2 weight percent.

9. A method for increasing magnetic permeability of a magnetic composition made according to the method of claim 1, comprising applying an external field to aid the alignment of a material dipole to increase magnetic permeability.

10. The method of claim 9, wherein said external field is applied in the same direction of a flux direction in a magnetic core.

* * * * *